United States Patent [19]

Slowik et al.

[11] Patent Number: 5,072,235

[45] Date of Patent: Dec. 10, 1991

[54] METHOD AND APPARATUS FOR THE ELECTRONIC DETECTION OF AIR INSIDE A THERMAL INKJET PRINTHEAD

[75] Inventors: John H. Slowik, Rochester; Stephen F. Pond, Pittsford, both of N.Y.

[73] Assignee: Xerox Corporation, Stamford, Conn.

[21] Appl. No.: 543,497

[22] Filed: Jun. 26, 1990

[51] Int. Cl.[5] ..... B41J 2/05

[52] U.S. Cl. ..... 346/1.1; 324/549; 346/140 R

[58] Field of Search ..... 346/140, 76 PH, 1.1; 324/549, 523, 525, 718

[56] References Cited

U.S. PATENT DOCUMENTS

| | | | |
|---|---|---|---|
| 4,466,005 | 8/1984 | Yoshimura | 346/140 |
| 4,518,974 | 5/1985 | Isayama | 346/140 |
| 4,550,327 | 10/1985 | Miyakawa | 346/140 |
| 4,590,482 | 5/1986 | Hay et al. | 346/140 |
| 4,595,935 | 6/1986 | Brooks | 346/76 PH |
| 4,625,220 | 11/1986 | Nagashima | 346/140 |
| 4,695,852 | 9/1987 | Scardovi | 346/140 |
| 4,774,526 | 9/1988 | Ito | 346/76 PH |
| 4,996,487 | 2/1991 | McSparran | 346/140 X |

OTHER PUBLICATIONS

Harmon et al.; Integrating the Printhead into the HP Deskjet Printer; H-P Journal, Oct. 1988, pp. 62-66.

*Primary Examiner*—Joseph W. Hartary
*Attorney, Agent, or Firm*—Oliff & Berridge

[57] ABSTRACT

A detection circuit for detecting the existence of non-collapsing bubbles in the ink cells of a thermal inkjet printhead is connected to a heater element of an ink containing cell. The detection circuit has a sensing element of low resistance when compared to the resistance of the heater element so that printing and detecting operations can proceed simultaneously. Current in the heater element is proportional to the potential drop across the sensing element. An amplifier is used to measure the potential drop and is connected to a blocking capacitor. Non-collapsing bubbles are detected if the voltage drop across the sensing element varies from a reference level.

18 Claims, 4 Drawing Sheets

METHOD AND APPARATUS FOR THE ELECTRONIC DETECTION OF AIR INSIDE A THERMAL INKJET PRINTHEAD

BACKGROUND OF THE INVENTION

1. Field of the Invention

The present invention pertains to electrical methods and devices for electronically detecting the presence of air (or other gas or vapor) inside a thermal inkjet printhead to sense whether an unfavorable printing condition exists. More specifically, the present invention relates to a detecting method and apparatus for sensing the presence of a non-collapsing bubble in a cell of a thermal inkjet printer, and activating a repriming circuit if the non-collapsing bubble is detected.

2. Discussion of Related Art

The advent of thermal inkjet printheads has brought affordability to high quality printing. Examples of thermal inkjet printheads are found in Drake et al, U.S. Pat. No. 4,789,425 and Drake et al U.S. Pat. No. 4,829,324. Thermal inkjet printing systems use thermal energy selectively produced by resistors located in capillary filled ink channels near channel terminating nozzles or orifices to vaporize momentarily the ink and form bubbles on demand. Each temporary bubble expels an ink droplet and propels it towards a recording medium. The printing system may be incorporated in either a carriage type printer or a pagewidth type printer. The carriage type printer generally has a relatively small printhead, containing the ink channels and nozzles. The printhead is attached to a disposable ink supply cartridge and the combined printhead and cartridge assembly is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed. For an example of a cartridge type printer, refer to U.S. Pat. No. 4,571,599 to Rezanka. In contrast, the pagewidth printer has a stationary printhead having a length equal to or greater than the width of the paper. The paper is continually moved past the pagewidth printhead in a direction normal to the printhead length and at a constant speed during the printing process. Refer to U.S. Pat. No. 4,829,324 to Drake et al for an example of pagewidth printing.

U.S. Pat. No. 4,829,324 mentioned above discloses a printhead having one or more ink filled channels which are replenished by capillary action. A meniscus is formed at each nozzle to prevent ink from weeping therefrom. A resistor or heater is located in each channel upstream from the nozzles. Current pulses representative of data signals are applied to the resistors to momentarily vaporize the ink in contact therewith and form a bubble for each current pulse. Ink droplets are expelled from each nozzle by the growth of the bubbles which causes a quantity of ink to bulge from the nozzle and break off into a droplet at the beginning of the bubble collapse. The current pulses are shaped to prevent the meniscus from breaking up and receding too far into the channels, after each droplet is expelled. Various embodiments of linear arrays of thermal inkjet devices are shown, such as those having staggered linear arrays attached to the top and bottom of a heat sinking substrate for the purpose of obtaining a pagewidth printhead, and large arrays of printhead subunits butted against each other to form an array having the length of a pagewidth. Such arrangements may also be used for different colored inks to enable multi-colored printing.

However, during normal printing operations, a non-collapsible bubble of air or other has may appear inside the cells or channels of an inkjet head. Such bubbles typically result through desorption from the ink or ingestion of air. These non-collapsing bubbles are not to be confused with the normal collapsing bubbles which are required to expel ink droplets in normal operation. If a non-collapsing bubble is sufficiently large or close to a heating mechanism, printing quality will be adversely affected. If a bubble becomes sufficiently large, the cell will no longer be able to emit droplets and blank spaces or deletions will appear in the printed characters.

Typically, a repriming operation has been the means by which printing quality is restored. When a user perceived that printing quality had diminished, he or she could manually activate a repriming function. Thus, manual activation of the repriming function has the disadvantage that corrective action is only taken upon visually perceiving a reduction in printing quality.

As a remedy, machines can be designed to continually reprime at preset intervals. However, needless consumption of ink and time are but two of the disadvantages in such systems.

Isayama, U S. Pat. No. 4,518,974 and Nagashima, U.S. Pat. No. 4,625,220 both disclose piezoelectric-type inkjet printing devices which ar equipped with detection circuits which detect variations in voltage levels in the piezoelectric elements positioned adjacent to the ink chamber of a nozzle located in the printing head. The detecting devices of the Isayama and Nagashima patents discern different voltage levels in the piezoelectric elements when air bubbles are present in an adjacent nozzle than when the nozzle is filled solely with ink. The detection circuit taught by Isayama is a rather complicated one which detects an oscillating component of the voltage appearing between a pair of terminals of a piezoelectric element. The devices of Isayama and Nagashima are further complicated by the presence of a piezo detection transducer which exists in addition to the bubble-generating transducer. Since the systems of Isayama and Nagashima are used with piezoelectric transducers, these references do not teach or suggest the present invention.

Of course, when air bubbles are detected as being present in the cell or chamber of the printhead, an air bubble removing system should be activated. Air bubble removing systems are disclosed in, for example,. Yoshimura, U.S. Pat. No. 4,466,005 and Scardovi, U.S. Pat. No. 4,695,852.

SUMMARY OF THE INVENTION

Accordingly, one object of this invention is to provide a device which can automatically detect and generate a signal for the removal of non-collapsing bubbles in a thermal inkjet so as to assure character quality.

Another object of the present invention is to provide a detection device which can monitor the cells of a printhead without interrupting the printing operation and without operator intervention.

Yet another object of the present invention is to provide a method for determining if non-collapsing bubbles are present in the cells of a thermal inkjet printhead.

These and other objects of the present invention are achieved by connecting the bubble-forming heating elements of a thermal inkjet printhead to a detecting circuit. Because gases and vapors have lower thermal conductivity than ink, the presence of a non-collapsing bubble in the vicinity of a heating element results in less heat being transferred and more heat being retained by the heating element. This retention of heat naturally causes the temperature of the heating element to rise which results in a change in the resistivity of the heating element. As electrical pulses are delivered to the heating element, the level of current traveling through the heating element will vary as resistance of the heating element varies. Since a heating element will have a different resistance when a non-collapsing bubble is present than when a non-collapsing bubble is absent, this fact can be used as the basis for developing a method and apparatus for the detection of such bubbles.

Since Ohm's Law defines a well known relationship between resistance and current (i.e., $V/R=I$), by calculating the average value of current present in a heating element which is in proximity to an ink-filled chamber, i.e., a chamber absent non-collapsing bubbles, a reference value can be determined which corresponds to the average value of current in the heating element over the duration of an electrical pulse. Should an average value of current in the heating element vary significantly from the reference value for the same pulse and duration, such a variance indicates the presence of a non-collapsing bubble.

To enable constant monitoring of non-collapsing bubbles in the cells of a thermal inkjet printhead, the line which supplies current to each bubble-forming heating element in the thermal inkjet printhead is connected to a detecting circuit. The detecting circuit has a sensing element of comparatively small resistance value when compared to the resistance of the heating element so a detection function can be conducted without affecting the printing operation of the printer. The current in the heating element is proportional to the potential drop across the sensing element to which it is connected. By connecting the detecting circuit to a calculating means which is connected to a comparing means, the calculated averaged value of current in the heating element over an electrical pulse duration can be compared to a reference value to determine whether a non-collapsing bubble is present which, if present, results in an unfavorable operating condition in a cell of a thermal printhead. If an unfavorable operating condition is detected, a signal from the comparing means is generated to initiate a repriming operation of the print head cells.

BRIEF DESCRIPTION OF THE DRAWINGS

A more complete appreciation of the invention and many of the attended advantages thereof will be readily obtained as the same becomes better understood by reference to the following detailed description when considered in connection with the accompanying drawings, wherein.

DESCRIPTION OF THE PREFERRED EMBODIMENTS

Figure 1:
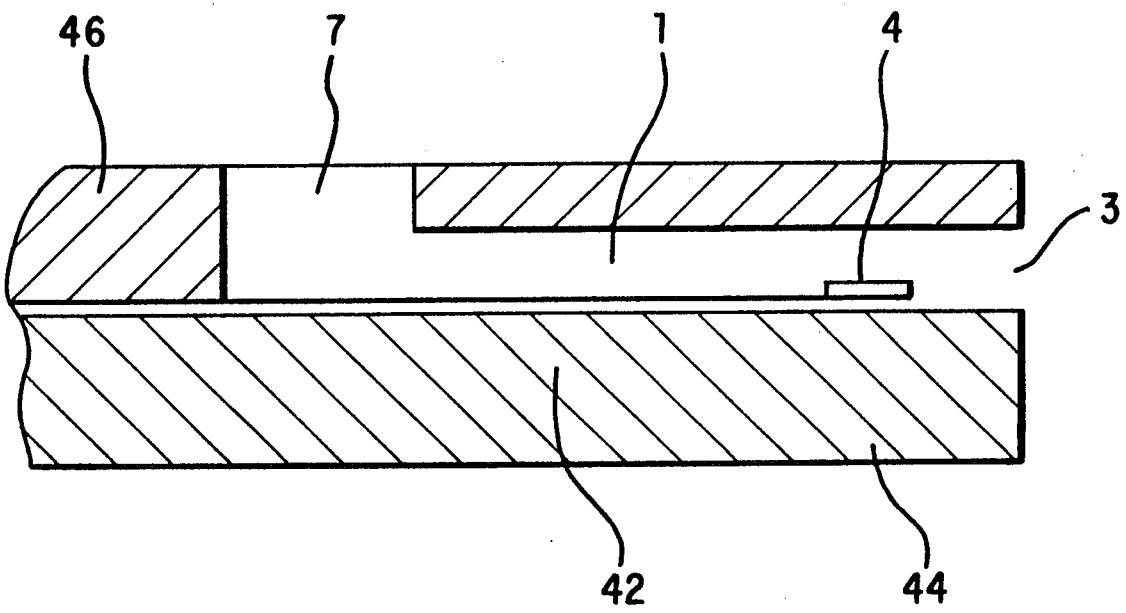
FIG. 1 PRIOR ART
FIG. 1 is a cross-sectional side illustration of a conventional thermal inkjet printhead including a heating element in communication with an ink channel adjacent a nozzle.

Referring now to the drawings wherein like reference numerals designate identical or corresponding parts through the respective figures, and more particularly to FIG. 1 thereof, a conventional thermal inkjet printhead is shown having a nozzle outlet 3 through which ink from channel or cell 1 is expelled. A heater element 4 lies in the channel proximate to outlet 3 and is connected to electrode 42 which lies atop heater plate 44. Channel 1 lies between heater plate 44 and channel plate 46. Ink fill hole 7 forms a cavity in channel plate 46 so as to allow the channel 1 to fill with ink. Thermal printheads are constructed from a channel plate and a heater plate which form a plurality of channels and heater elements. These printheads are formed on silicon chips by methods as those disclosed in U.S. Pat. No. 4,829,324 to Drake et al which is hereby incorporated by reference.

Figure 2:
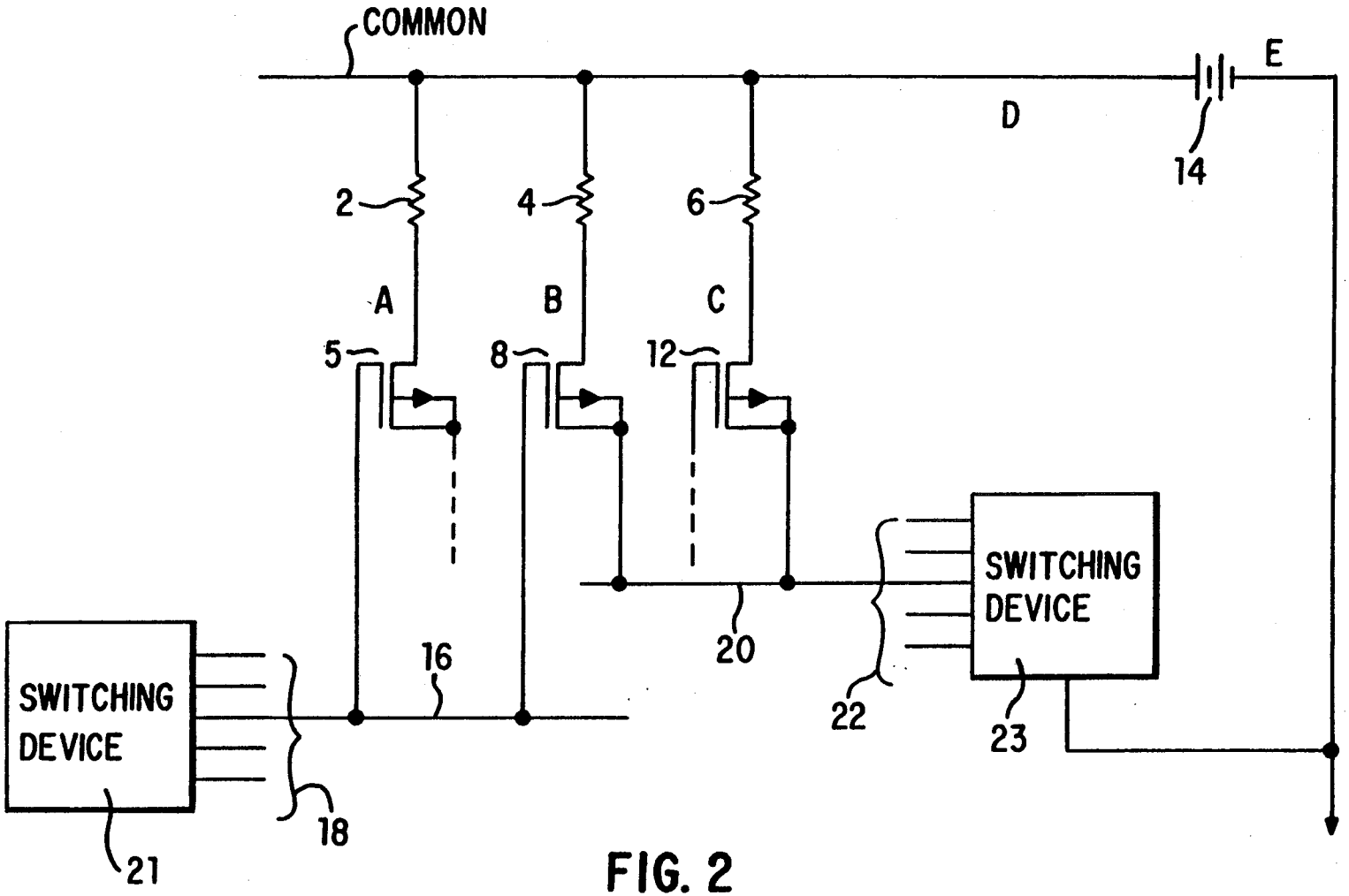
FIG. 2 is a simplified schematic circuit diagram of a heater plate in a thermal inkjet device.

FIG. 2 illustrates an active thermal ink jet device which has a heater 4 and transistor 8 which are connected in series so as to form a node B. Transistor 8 is addressed through a gate line 16 which is one of a plurality of gate lines 18. Gate line 16 also connects to other transistors which are represented by transistor 5 which is connected in series with heater 2 so as to form node A. Sink line 20, which is one of a plurality of sink lines 22, connects transistor 8 to a switching device 23 which selectively attaches sink line 20 to a low impedance to ground. Sink line 20 also connects to other transistors which are represented by transistor 12 which is connected in series with heater 6 so as to form node C. FIG. 2 serves to illustrate how a plurality of heating elements each corresponding to an ink cell of a printing head are connected to various gate lines and sink lines. Heater 4 alone receives a current pulse when 1) gate line 16 is switched to a potential by switching device 21 which turns on all transistors sharing the gate line 16; and 2) sink line 20 is switched by switching device 23 to a low impedance to ground. Being thus activated, heater 4 emits thermal energy which is dissipated into the ink (not shown) contained in cell 1 such that the ink nucleates into a bubble. When the bubble expands, an ink droplet is forced out of the hole 3 whereupon the bubble collapses. Thus, it can be seen how different cells can be activated to release ink.

Figure 5:
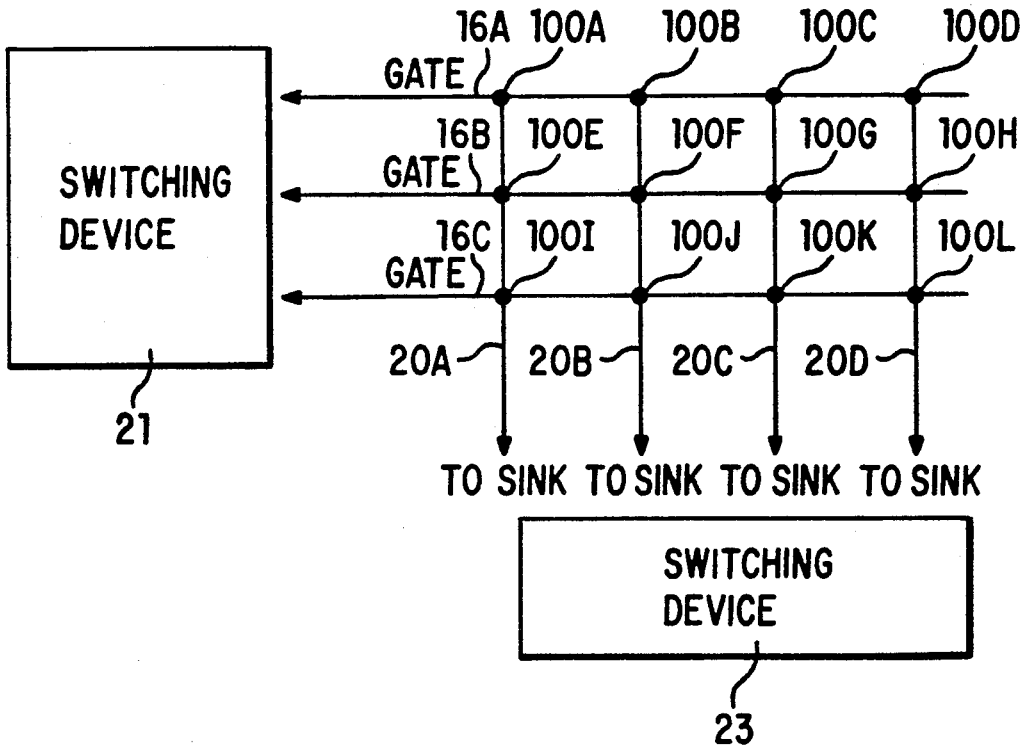
FIG. 5 is a schematic diagram of a multiplex addressing system for activating the particular cells in a printhead array.

FIG. 5 serves to illustrate a multiplex system which allows any of the heating elements associated with each cell 100 in a printhead array to be activated by the above-described procedure. In particular, any one cell (100A, 100B, 100C . . . 100L) is activated when its corresponding gate line (16A, 16B, 16C) and sink line (20A, 20B, 20C, 20D) are activated. For example, to activate cell 100G, gate line 16B (which is one of the plurality of gate lines 18) and sink line 20C are activated by the switching devices 21, 23, respectively.

Thermal inkjet printheads can have passive or active arrays of heater elements. A passive heating element requires that each heating element be given a corresponding addressing electrode. An example of a passive-type array is demonstrated in U.S. Pat. No. 4,829,324 to Drake et al. However, an active array by utilizing various sink and gate lines connected to transistors can activate heating elements by the method already discussed. An example of a thermal printhead having an active array is disclosed in U.S. Pat. No. 4,651,164 to Abe et al, the disclosure of which is herein incorporated by reference . Since transistors and sink and gate lines can be provided on the same heating plate as the heating elements, space is saved by utilizing active arrays. However, the present invention is applicable to either active or passive arrays.

Figure 3:
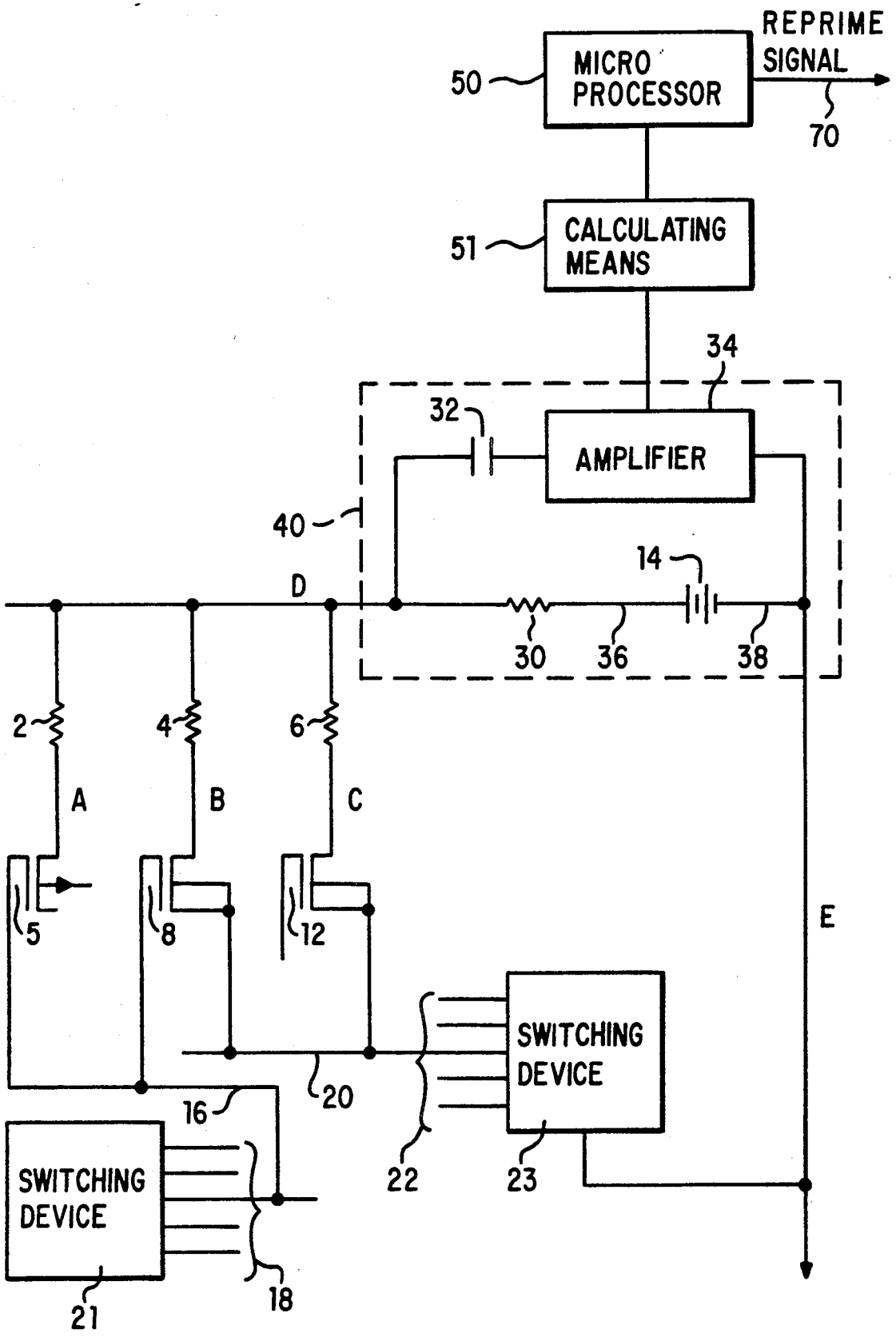
FIG. 3 is a schematic circuit diagram of the heater plate of FIG. 2 connected to the detection device of the present invention.

With reference to FIG. 3, during a current pulse which typically lasts three microseconds, a constant potential is applied across the heater 4. However, current through the heater varies during the pulse because rising temperature changes the heater's resistance. In general, heaters made from any material change resistance when the temperature of the heater is varied. In the case of a semiconducting material such as silicon, an increase in temperature will increase or decrease the resistance of silicon depending on how the silicon is doped. However, the principles of the present invention apply to any type of doping condition. Further, heat dissipates more slowly if any liquid inside an ink containing cell is displaced by a bubble. Tests have demonstrated that extraneous bubbles will increase the rate of temperature rise of the heater because bubbles have lower thermal conductivity and heat capacity than ink.

Large switching oscillations can be detected when heater 4 is activated. As a result of the heat-induced resistance change of the heater, current levels in the heater fluctuate. The average value of current during a three microsecond pulse is given a particular reference value which corresponds to an average current reading when the cell 1 connected to heater 4 is free of non-collapsing bubbles.

Tests have shown that the presence of a non-collapsing bubble causes a current differential whose existence can be used as the basis for a practical means of detecting the presence of a non-collapsing bubble. Current differences are greatest, 2 to 3% difference from the reference value, when a large non-collapsing bubble covers a heater, and are smaller when bubbles are smaller and more remote from the heater and thus less prone to interfere with heat conduction. This 2 to 3% difference has been experimentally verified. Thus, current readings averaged over the 3 microsecond interval can be used to detect whether a bubble present in a printhead is likely to cause printing defects. A threshold value for the current difference is chosen so as to correspond to the bubble size which is sufficient to cause a printing defect. When the averaged current differs from the reference value by more than a threshold amount, the presence of a non-collapsing bubble is verified and it is time to reprime the printhead. A signal can be generated to initiate a repriming operation.

Circuitry to measure heater current can be added to the design of FIG. 2 by accessing nodes D and E.

FIG. 3 shows a detecting circuit 40 which is connected to the circuitry depicted in FIG. 2 by accessing nodes D and E. It is noted that nodes D and E are external to the printhead, so no chip modifications are necessitated. It is further noted that the same type of air detector can be used for printheads composed of passive devices since the same nodes are available.

Detecting circuit 40 is shown to have a relatively small-valued sensing element or resistor 30 which is electrically connected to node D which is the line which supplies current to all heaters. Current in the heater 4 is proportional to a drop in potential v(t) across the sensing resistor 30. Sensing resistor 30 is shown to be serially connected to power supply 14. A sensing resistor, e.g. resistor 30, which was used as a working model had a resistance of 4 ohms which is relatively smaller compared to the 100–300 ohm resistance of the heater 4. However, even smaller values of resistance may well suffice. Further, the resistance contained in power supply 14 and connecting leads 36 and 38 may be sufficient for use as a sensing element. Amplifier 34 and capacitor 32 are in parallel with sensing resistor 30 and power supply 14. The connection between amplifier 34 and blocking capacitor 32 results in the amplifier 34 being AC coupled.

By providing a sensing resistor 30 having a much smaller resistance than that of heater 4, heater 4 having a resistance of approximately 100 to 300 ohms, bubble detection device 40 has a negligible influence on normal ink jet operations. Thus, detector 40 can operate on-line and test constantly for the presence of a non-collapsing bubble in an ink cell without interrupting the printing operation. One detection circuit 40 is sufficient to serve all cells sharing the same current supply lines as long as the cells can be independently addressed.

Amplifier 34 of detection circuit 40 is connected to calculating means 51 which samples and holds the analog signals received from the amplifier over the pulsed interval and converts analog signals to digital signals. Calculating means 51 calculates the averaged value of current over the pulsed interval and transmits that value to a microprocessor 50 which compares the averaged value of current in a tested heater with a reference value and activates a reprime signal 70 if the comparison indicates the presence of a non-collapsing bubble (i.e., when the averaged value differs from the reference value by more than the threshold amount).

The reference value for each cell is determined by taking averaged readings of the current present in each cell's heater when the cell is printing properly. These averaged readings, which are taken over pulse intervals, are then translated to a reference value which is stored in the memory of microprocessor 50. The reference value can then be compared with any subsequent averaged value of current in a heater to determine the presence of a non-collapsing bubble. A difference of more than a programmable or selectable threshold amount between the reference value and the average value indicates the presence of a noncollapsing bubble. When this difference is detected, the microprocessor will activate a reprime signal.

Heater resistances (e.g. in heaters 2, 4, and 6, etc.) are usually relatively uniform so that heater currents can be compared with a single reference value to determine whether a bubble is present. If heaters lack uniformity in resistance, the bubble detection circuit's 40 output could be compared to a set of reference levels stored in the microprocessor's memory.

Microprocessor 50 is programmed to synchronize the detector output with heater pulsing and to disregard detector output for those cells which are not pulsed during a particular cycle.

Figure 4:
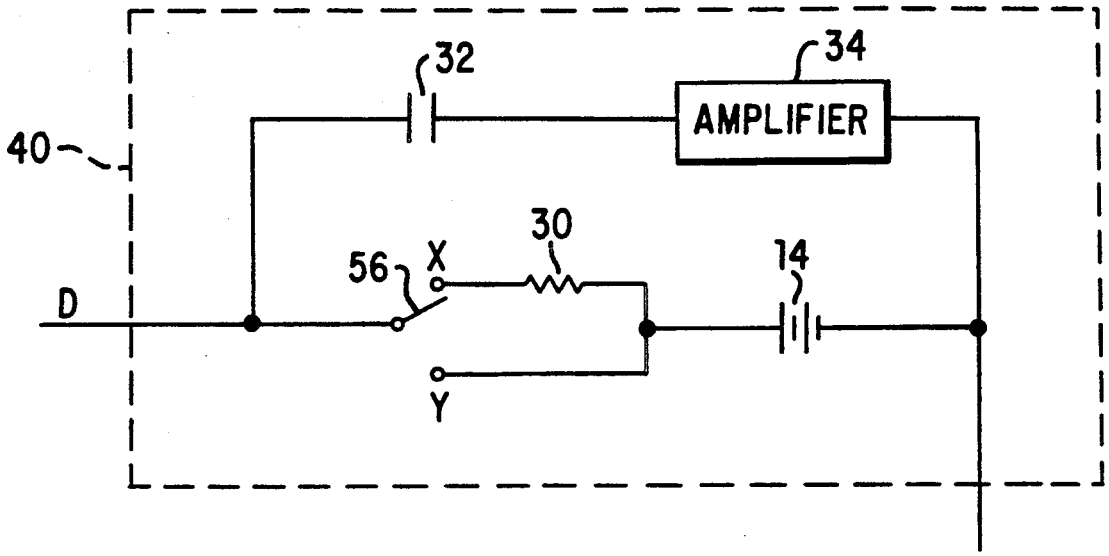
FIG. 4 is an alternative embodiment of the detection device of the present invention.

In the laboratory, switching noise was controlled through averaging, integrating or filtering. Noise reduction was also obtained by using a larger value for the sensing resistor, for example 50 ohms. If circumstances required such a large resistance so that interference with normal printing operations resulted, the sensing resistor could be situated outside of the closed circuit shown in FIG. 3. FIG. 4 shows detecting circuit 40 with switch 56 which can be alternately connected to points X or Y. Should testing of the cells for bubbles be desired, switch 56 connects to point X so that current flows through resistor 30 which is of relatively high resistance when compared to the heating element. When detection circuit 40 is not in a detecting mode, switch 56 connects to point Y so that resistor 30 is bypassed and the operation of the heating element is unaffected. Then, periodically, printing could pause so that the sensing resistor could be switched into the circuit and the detector cycle run. As before, a need for repriming would be sensed and repriming could be automatically activated.

The foregoing description of the preferred embodiment is intended to be illustrative and not limiting. Numerous additional modifications and variations of the present invention are possible in light of the above teachings. It is therefore to be understood that the invention may be practiced otherwise than as specifically described herein and still be within the scope of the appended claims.

What is claimed is:

1. A printer having a system for detecting during a normal printing operation the presence of a non-collapsing bubble in a cell of a thermal inkjet printhead, comprising:

a heating element proximate to the cell;

means for applying an electrical pulse to said heating element for a predetermined duration to affect said printing operation; and detection means connected to said heating element for detecting during said printing operation at least one change in current level over the predetermined duration in said heating element, said at least one change in current level resulting from changing resistivity in said heating element brought about by a temperature change in said heating element.

2. A system according to claim 1, wherein:

a voltage drop across a sensing element of said detection means is proportional to the current through said heating element.

3. A system according to claim 2, wherein:

the resistance of said sensing element does not affect the operation of said heating element.

4. A system according to claim 1, further comprising:

calculating means connected to said detection means for calculating an average value of currents through said heating element over the predetermined duration, said average value being the average current value during said predetermined duration.

5. A system according to claim 4, further comprising:

comparing means connected to said calculating means for comparing said average value with a reference value.

6. A system according to claim 5, wherein:

said comparing means includes signal outputting means for outputting a signal indicative of an unfavorable printing condition when the average value differs from the reference value.

7. A system according to claim 5, wherein a difference of more than a programmable threshold amount between the reference value and the average value indicates the presence of a non-collapsing bubble in said cell, said bubble being large enough to make repriming desirable.

8. A device for detecting during a normal printing operation the presence of a non-collapsing bubble in a cell of a thermal inkjet printhead having a heating element proximate to the cell, comprising means for applying an electrical pulse to said heating element for a predetermined duration to affect said printing operation;

sensing means connected to said heating element for sensing during said printing operation a plurality of current levels in said heating element over the predetermined duration, said plurality of current levels resulting from heat-induced changes in the resistance of said heater; and wherein a voltage drop across the sensing means is proportional to a current in said heating element.

9. A device according to claim 8, wherein said sensing means has a resistance which is significantly less than said heater so as not to affect a printing operation.

10. A device according to claim 8, further comprising:

switching means for selectively disconnecting the heating element from said sensing means.

11. A device according to claim 8, wherein:

said sensing means has a resistance that does not affect operation of said heating element.

12. A method for detecting during a normal printing operation the presence of a non-collapsing bubble in a cell of a thermal inkjet printhead, comprising the steps of:

applying an electrical pulse to a heating element proximate to said cell of a predetermined duration to affect said printing operation; and detecting during said printing operation a plurality of voltage levels across a sensing means at different intervals during said predetermined duration, said sensing means being connected to said heating element and said plurality of voltage levels resulting from changing resistivity of said heating element due to changes in the temperature of said heating element over said predetermined duration.

13. A method according to claim 12, further comprising the step of: averaging said plurality of voltage levels to obtain an average value.

14. A method according to claim 13, further comprising the step of:

comparing said average value with a reference value.

15. A method according to claim 14, further comprising the step of:

determining if the average value differs from said reference value to indicate the presence of a non-collapsing bubble in said cell.

16. A method according to claim 15, wherein a difference of more than a programmable threshold amount between the reference value and the average value indicates the presence of a non-collapsing bubble in said cell.

17. A method according to claim 15, further comprising the step of:

generating a reprime signal when the comparison of said average value with said reference value indicates the presence of a non-collapsing bubble in said cell.

18. A method according to claim 12, wherein the sensing means has a resistance which does not affect the operation of the heating element.

* * * * *